US005829067A

United States Patent [19]

Smith

[11] Patent Number: 5,829,067

[45] Date of Patent: Nov. 3, 1998

[54] TOILET SEAT LIFT ASSEMBLY

[76] Inventor: Randy Roy Smith, 248 SW. 47th St., Cape Coral, Fla. 33914

[21] Appl. No.: 659,871

[22] Filed: Jun. 7, 1996

[51] Int. Cl.[6] ..... A47K 13/10

[52] U.S. Cl. ..... 4/246.1; 4/249

[58] Field of Search ..... 4/246.1–246.5, 4/249, 250

[56] References Cited

U.S. PATENT DOCUMENTS

| | | |
|---|---|---|
| D. 326,599 | 6/1992 | Callahan . |
| D. 349,952 | 8/1994 | Evans et al. . |
| 3,935,601 | 2/1976 | Hermann . |
| 4,584,724 | 4/1986 | Wilson . |
| 4,803,741 | 2/1989 | Ellison . |
| 4,853,983 | 8/1989 | Grant . |
| 4,951,324 | 8/1990 | Lirette . |
| 4,975,988 | 12/1990 | Won . |
| 5,056,165 | 10/1991 | Wescott, Sr. . |
| 5,237,708 | 8/1993 | Zamoyski . |
| 5,291,618 | 3/1994 | Chiang . |
| 5,323,496 | 6/1994 | Blair . |
| 5,375,267 | 12/1994 | Davis . |

OTHER PUBLICATIONS

US patent search results—29 pages (search conducted Jul. 11, 1995).

*Primary Examiner*—Charles E. Phillips
*Attorney, Agent, or Firm*—Laura G. Barrow

[57] ABSTRACT

An improved hand-activated toilet seat/lid lifting apparatus is described that is configured for attachment to the side of a toilet, both commercial and residential designs, to allow the user to lift the toilet seat without having to directly touch the seat. The lifting apparatus may also include a flushing means connected to the existing flush lever of the toilet to allow the user to flush the toilet with the lifting apparatus without having to touch the flush lever itself.

10 Claims, 8 Drawing Sheets

TOILET SEAT LIFT ASSEMBLY

I. BACKGROUND OF INVENTION

1. Field of Invention

The present invention relates to a device for lifting and lowering a toilet seat.

2. Background of the Invention

Because of the unsanitary nature of the toilet, the benefits of devices that allow the user to raise and lower the toilet seat and/or lid without directly touching the seat/lid are well-recognized in the art. There are many devices disclosed that provide for hand, foot, or hand/foot actuation thereof; however, many either require complex electrical or mechanical components, or are too cumbersome to attach to the toilet. Examples of various foot-actuated toilet seat lifting devices include those disclosed in U.S. Pat. Nos. 5,237,708 (Zamoyski), 5,323,496 (Blair), and 4,803,741 (Ellison), 5,056,165 (Wescott, Sr.). U.S. Pat. No. 4,584,724 to Wilson discloses a toilet seat lifting device that may be actuated by either hand or foot, and U.S. Pat. No. 4,951,324 to Lirette discloses a toilet seat lifting device that may be actuated by either hand or knee.

II. SUMMARY OF THE INVENTION

It is an object of the present invention to provide a hand-operated toilet seat/lid lifting apparatus that is simple in design, easy to assemble and mount to a toilet, and fully adjustable for different designs of toilets, both for residential and commercial use.

It is further an object of the present invention to provide for a convenient flushing mechanism wherein the same toilet seat/lid assembly may be secured to the existing flush lever of the toilet to actuate the flush lever, if desired, without necessitating user hand contact with the existing flush lever.

These and other objects of the present invention are achieved by providing a toilet assembly comprising, in combination:

a toilet bowl having an upper surface; a seat pivotly secured and positioned rearwardly on said upper surface of said bowl; and a seat lift apparatus mounted on a side of said toilet bowl, said apparatus further comprising: a lower lift device having a lower member secured below the toilet bowl, an upper member pivotly connected to the lower member at one end, and a bar secured at a second end of said upper member and beneath the seat, wherein the seat rests upon the bar;

an upper lift device secured to said upper member at one end; and a guide having upper and lower surfaces and further configured to define an aperture through which said upper lift device is positioned and guided upon movement therethrough;

whereby when said upper lift device is pulled forward within said guide, said bar moves rearwardly as said upper member of said lower lift device moves upward to lift said seat.

Alternatively, the lifting apparatus may adjusted and used to lift a toilet lid, or secured to any other container having a lid that is connected to the container by a hinge or similar pivot means. Other features of the preferred embodiment include means for preventing the lid/seat from being raised too far as well as a means for preventing the seat/lid from lowering without user activation of the apparatus.

The present invention may also include a mechanism for flushing the toilet without direct user hand contact with the toilet's existing flush lever or flush bar. Preferably, in one forward motion of the lifting apparatus, the user can lift the toilet seat/lid, and in a combination rearward/downward motion, the user can subsequently flush the toilet.

The foregoing objects and features of the invention, as well as other objects and features, will become more fully apparent when the following detailed description of the invention is read in conjunction with the accompanying drawings.

III. BRIEF DESCRIPTION OF THE DRAWINGS

IV. DETAILED DESCRIPTION OF THE PREFERRED EMBODIMENTS

Figure 4:
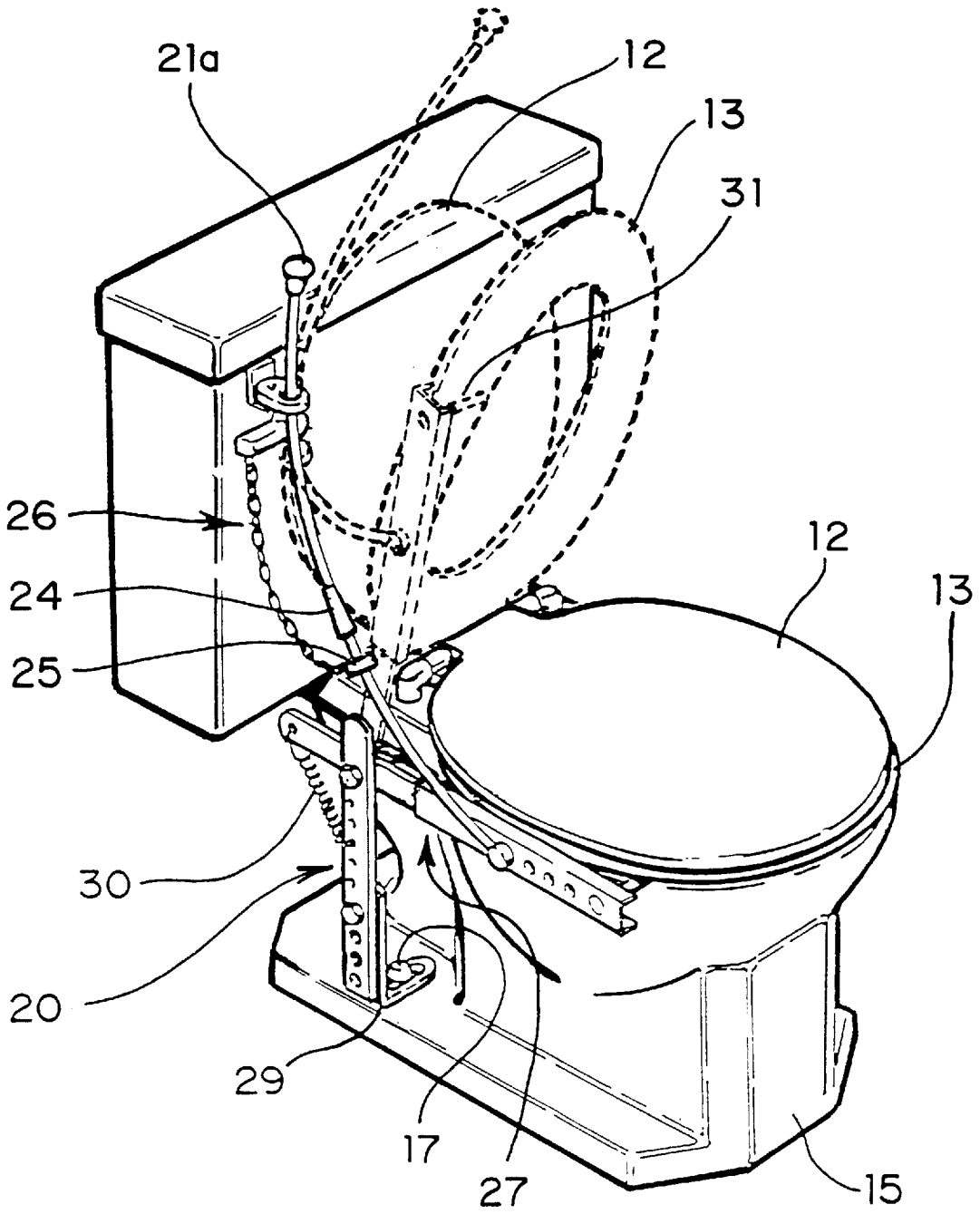
FIG. 4 is a perspective view of the toilet seat assembly illustrated in FIGS. 1–3, and further illustrating the operation of the toilet seat lifting apparatus.
Figure 5:
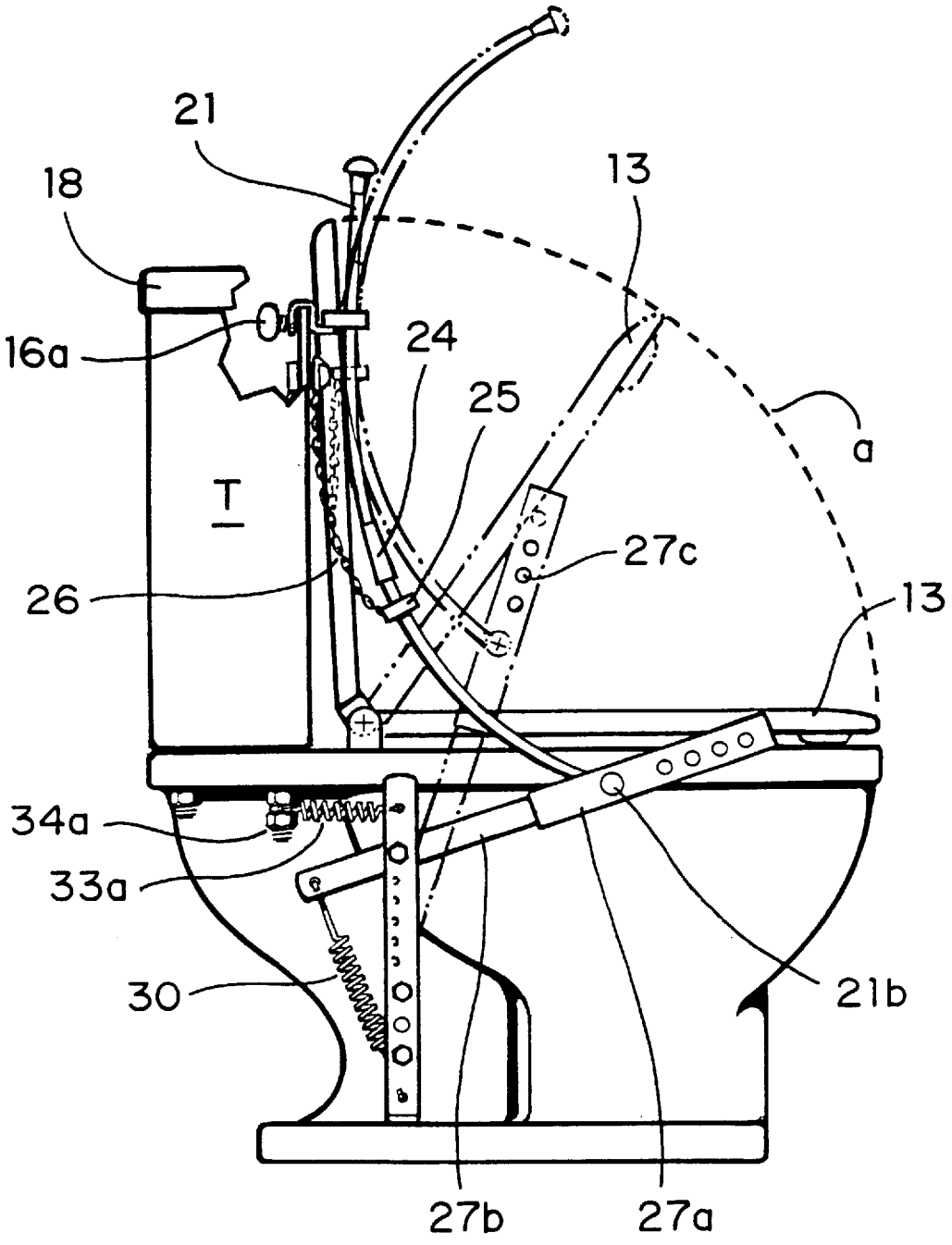
FIG. 5 is a side view of the assembly illustrated in FIG. 4.
Figure 6:
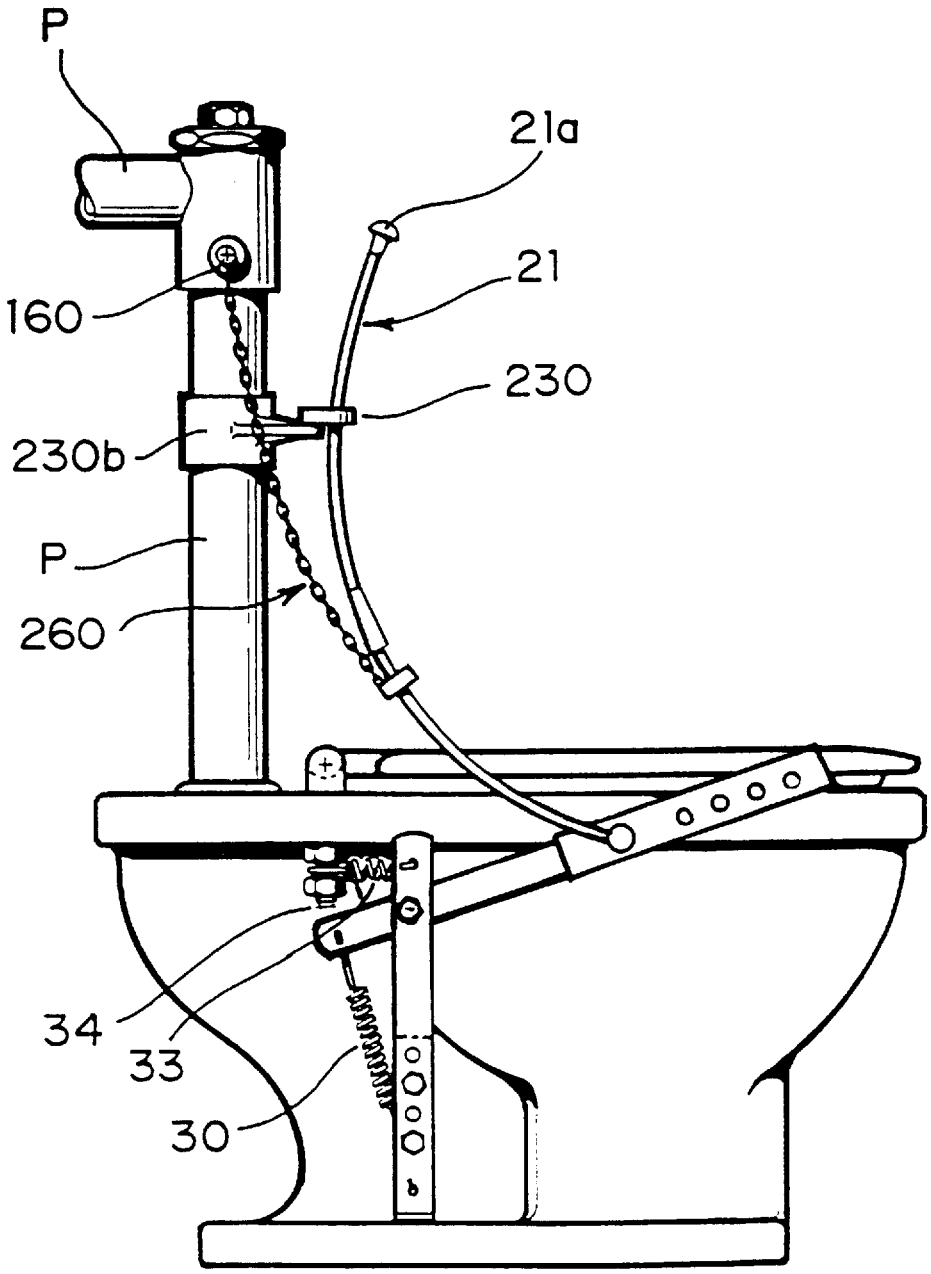
FIG. 6 is a side view of a the toilet seat lifting apparatus attached to a toilet designed primarily for commercial use.
Figure 7:
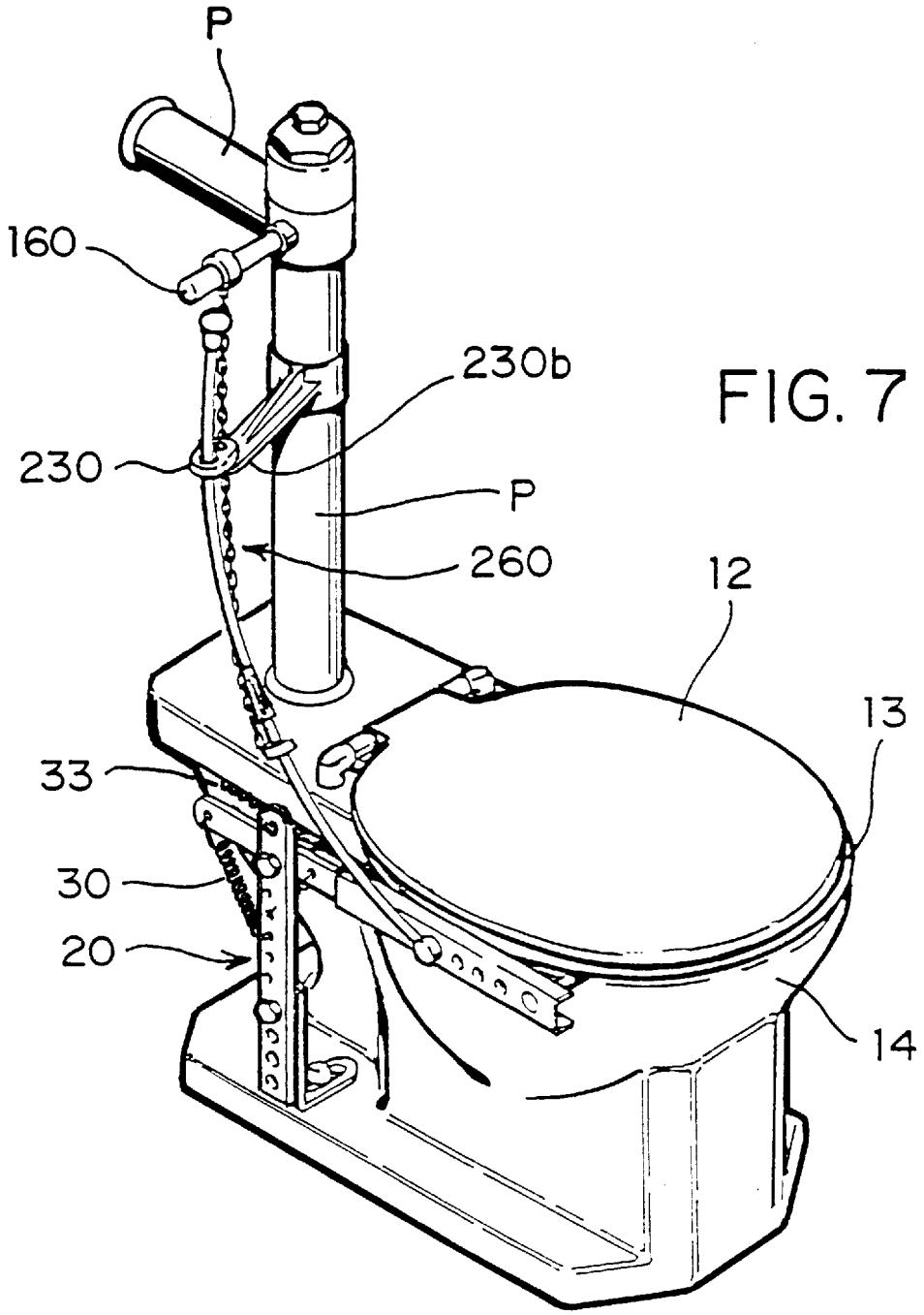
FIG. 7 is a perspective view of the toilet seat lifting apparatus mounted on another type of commercial toilet.

Referring now to FIGS. 1–5, the inventive toilet seat lifting apparatus may be attached to a toilet (10) designed for residential use, typically having a tank (T) as a means for storing and moving fluid into the toilet bowl (14) (FIGS. 1–5), or it may attached to a toilet (101) typically used in commercial settings, such as that illustrated in FIGS. 6 and 7 having a conduit or pipe (P) through which fluid is moved into the toilet bowl (14). For ease explanation, the present invention will be described with reference to toilets; however, it is well within the scope of the invention that the lifting apparatus may be mounted to any container having a pivotly connected lid to allow the user to lift the container lid without direct hand contact. Exemplary containers may include, but are not limited to, garbage containers and recycling bins.

Conventional toilets, as illustrated in the figures, have a seat (13) and typically a lid (12). Both the seat and lid are pivotly connected rearward to the upper portion of the toilet at about point (b), for example, as best illustrated in FIGS. 2 and 5.

Figure 1:
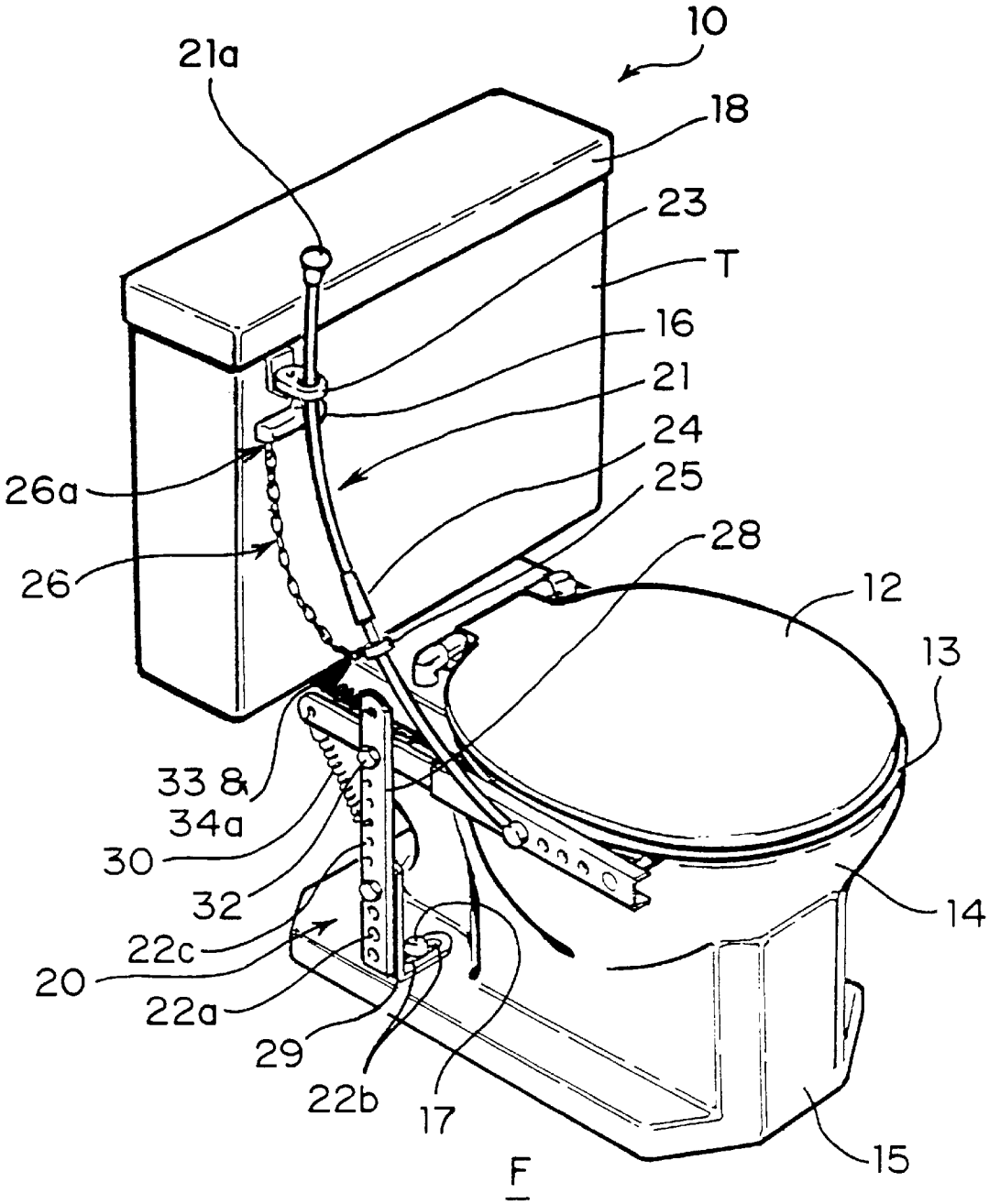
FIG. 1 is a perspective view of the toilet seat lift apparatus attached to a standard toilet designed for residential use.
Figure 2:
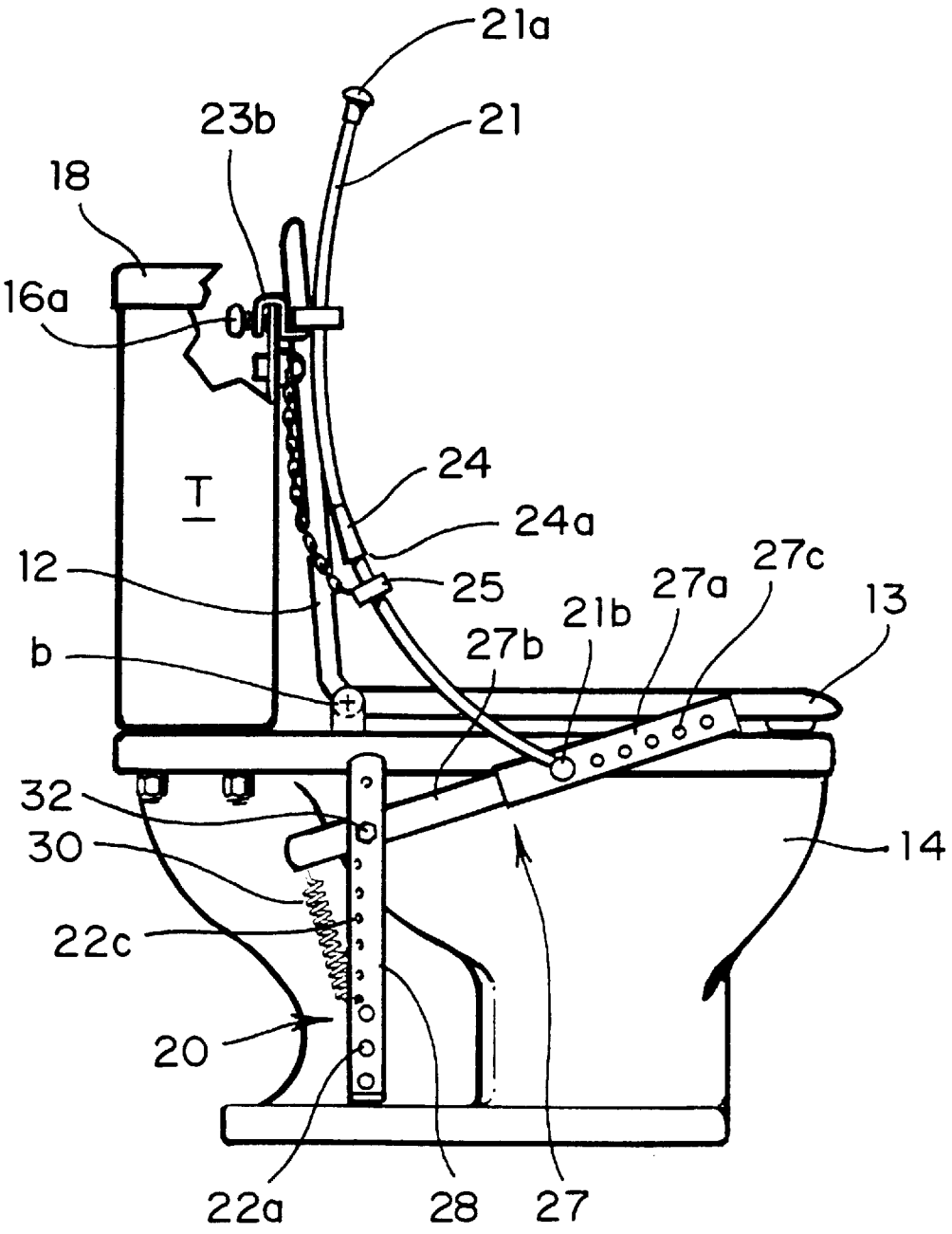
FIG. 2 is a side view of the toilet seat lift apparatus attached to the toilet illustrated in FIG. 1.

In the preferred embodiment as shown in FIGS. 1–2, for example, the inventive lifting apparatus comprises a lower lift device (20) having a lower member (28) pivotly connected to an upper member (27) by a fastener (32). The length of the upper member (27) is preferably adjustable, and thereby may comprise two segments (27*a*, 27*b*) wherein segment (27*a*) may be positioned at a desired location along the outer (or inner) surface of segment (27*b*). Most preferably, segment (27*a*) comprises U-channel edges (not shown) for slidable engagement onto segment (27*b*).

As shown most clearly in FIGS. 1 and 4, the upper member (27) further includes a bar (31) secured at one end and positioned underneath, and in contact with the toilet seat (13) such that the seat rests upon or against the bar (31). As shown in FIG. 2, the lower end (21*b*) of the upper lift device includes a hole (27*c*), preferably a series of threaded holes, through which the bar (31) may be engaged. Provision of a plurality of holes (27*c*) as shown allows for adjustment of the bar (31) along the upper lift device to accommodate different size toilet bowls and/or the extent of lifting.

Figure 8:
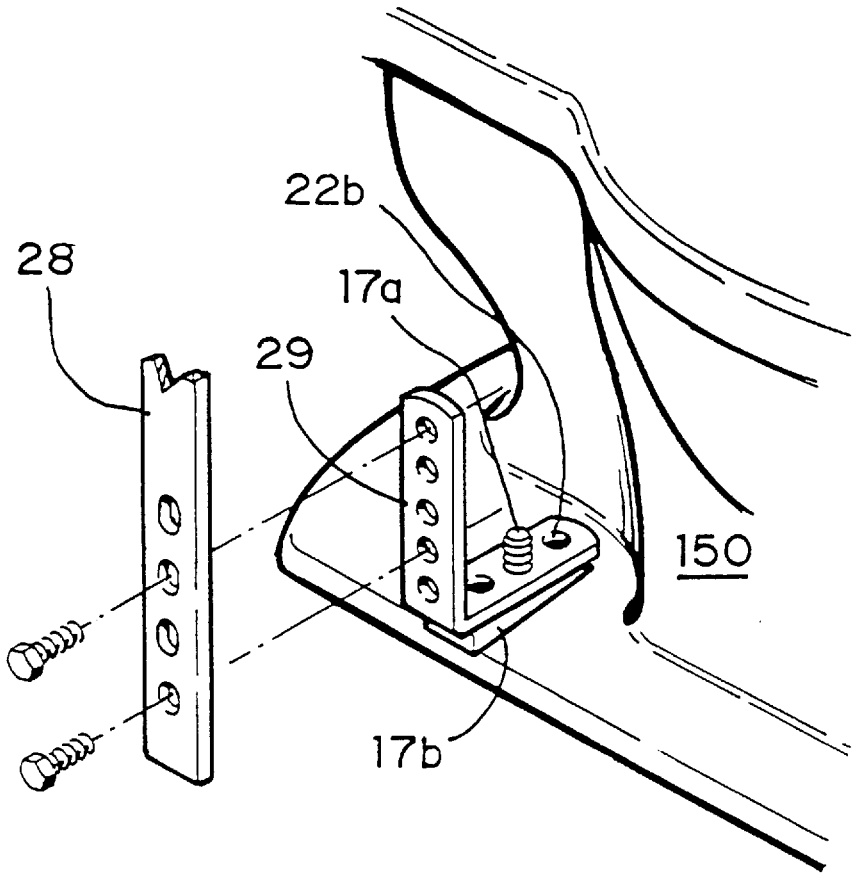
FIG. 8 is a view of the base portion of a toilet showing another means of securing the toilet seat lifting apparatus to the base bolt of the toilet

The lower member (28) of the lower lift device (20) most preferably is fastened directly to a bolt (17) located on the base (15) of the toilet (10), preferably by a L-shaped bracket (29), or it may be directly secured to the floor (F) (not shown). FIGS. 1, 4, and 7, for example, illustrate the L-shaped bracket secured to the base bolt (17) through a hole (29) on a more common toilet base design. Some toilets, shown in FIG. 8, have a base bolt (17*a*) that is engaged in a wedge-shaped hole in the base (150) as shown. In this latter embodiment, a wedge piece (17*b*) is inserted in the hole to maintain the L-shaped bracket in a level position.

The lower lift device may be further secured to the toilet as shown in FIG. 6, for example, by means of a spring (33) which is secured at one end to the lower member (28) of the lower lift device (20) and at the other end to the preexisting toilet seat bolt (34) or to the pre-existing tank bolt (34*a*), as shown in FIG. 1, for example. Alternatively, a rigid extension bracket (33*a*) may be employed instead of the spring (33), as shown in FIG. 5. In the latter embodiment, the extension bracket (33*a*) preferably has a slot (not shown) through which the bolt (34) may be inserted and subsequently fastened to the toilet.

As shown most clearly in FIGS. 1–2, the lower lift device (20) is also preferably fully adjustable for toilets of different sizes. Specifically, the lower member of the lower lift device has a series of holes (22*a*) which may be aligned with complementary holes of the L-bracket (29) to allow for height adjustment of the lower member. These holes (22*a*) may be threaded for engagement with a screw or threaded bolt. The distance between the toilet and the lifting apparatus may be adjusted by means of a series of holes (22*b*) positioned through the lower portion of the L-bracket (29) through which the bolt (17) on the toilet base (15) may be engaged. The lower member may further include a separate series of holes (22*c*) positioned near the spring (30) which aid in adjusting the tension of the spring.

As shown in most of the figures, the inventive lifting apparatus further includes an upper lift device (21) having a handle (21*a*) at one end and is connected to the upper member (27) of the lower lift device (20) at the other end. As shown, the upper lift device (21) is generally curved and preferably flexible. The upper lift device is positioned within a guide (23) that is mounted onto the toilet tank (T). The guide (23) preferably includes a ring formed of metal or other durable material, yet irrespective of shape, it further defines an aperture (23*a*) (FIG. 3) having a diameter large enough to allow the upper lift device (21) to move easily therethrough. The guide (23) further includes a means for attachment (23*b*, 230*b*) to the tank (T), as shown FIGS. 2 and 7, for example. As illustrated in FIG. 2, the attachment means may be a bracket (23*b*) configured to slide onto the edge of the toilet tank. The guide may be further secured to the tank (T) by means of a bolt (16*a*) or other suitable fastener as well as the tank lid (18). In commercial toilets having a conduit (P) in lieu of a tank (T), the guide (230) may be configured as illustrated in FIG. 7 wherein the attachment means is a screw clamp (230*b*) secured onto the conduit. While the figures illustrate preferred designs for the guide, variations of these designs may be made without departing from the scope of the present invention, in particular the means by which the guide is secured to the toilet, for example.

The inventive toilet seat lifting apparatus preferably comprises other features, which will be described below in connection with its operation.

FIG. 1 illustrates the inventive toilet seat lifting apparatus secured to the side of the toilet (10). Both the toilet lid (12) and seat (13) are in the "closed" or horizontal position, with the upper lift device (21) being in the "home" position, as shown in FIG. 1 and in FIG. 4 (solid lines). In FIG. 2, the lid (12) is in the "lifted" or vertical position while the seat (13) is in the closed position (the upper lift device (21) is in the home position). The "ghost" lines depicted in FIGS. 4 and 5 illustrate the lid (12) and seat (13) in the lifted position as well as the upper lift device (21) in the "forward" position. When the user (not shown) pulls vertically upward upon the handle (21*a*) of the upper lift device (21) and then subsequently forward in the direction of the user to the forward position, the lower end (21*b*) of the upper lift device moves the upper member (27) of the lower lift device rearward. The bar (31) secured to the upper member (27) and positioned beneath, and in contact with, the seat (13) also moves rearward to lift the seat upward about arc "a" (FIG. 5).

Figure 3:
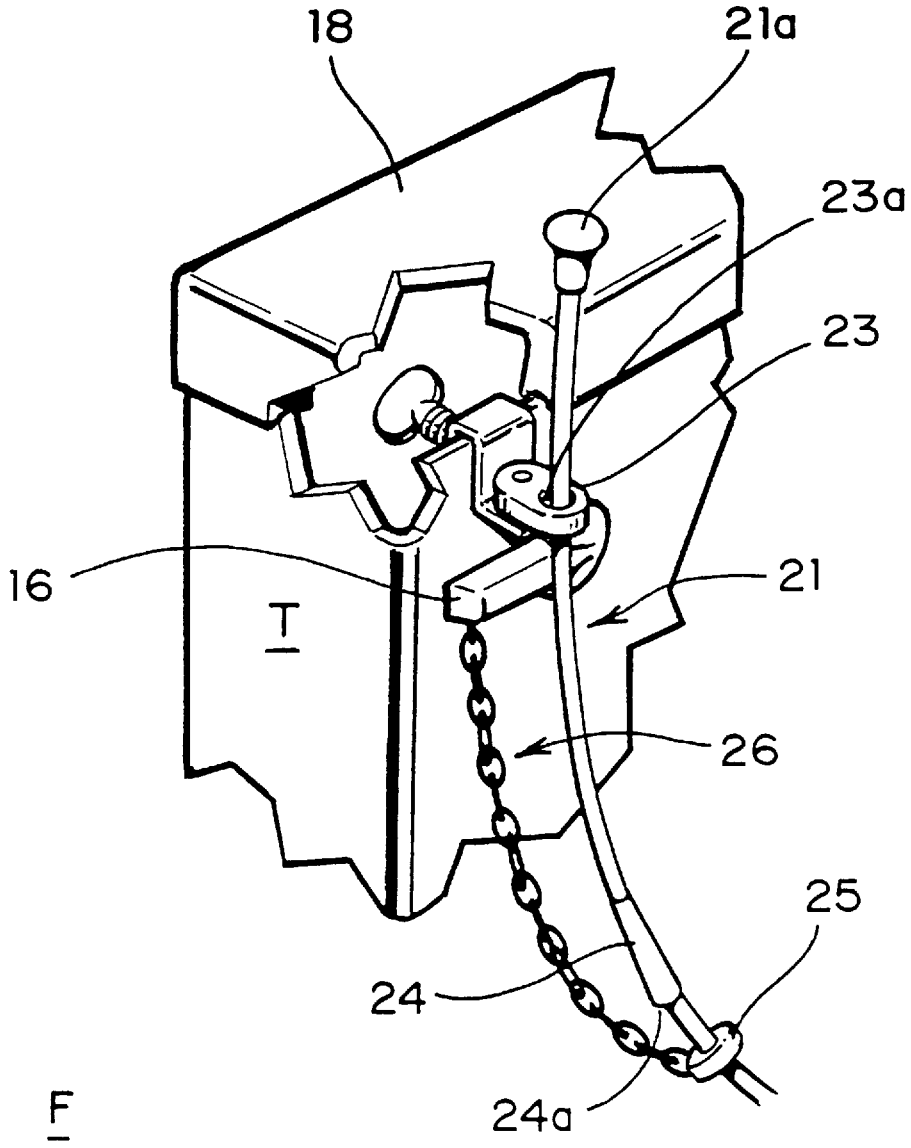
FIG. 3 is an enlarged view the toilet seat lift assembly illustrating the handle and flush mechanism of the toilet seat lifting apparatus shown in FIGS. 1 and 2.

Preferably, the upper lift device (21) further includes a stop (25) mounted thereon and below the guide (23), as shown in FIGS. 1 and 3, for example. Provision of a stop prevents the user from pulling the upper lift device too far forward, which might cause the seat or lid to bang against the side of the tank. To serve this function, the stop (25) preferably has a horizontal width larger than the aperture (23*a*) of the guide (23) to prevent the stop from moving therethrough. The upper lift device (21) also preferably has a retaining means (24) positioned above the stop but below the guide (23). Unlike the stop, the retaining means is designed to pass through the aperture of the guide when the upper lift device is moved to the forward position. The retaining means (24) has a generally flat lower surface (24*a*), such that when the retaining means passes through the guide, it rests on the upper surface (23*a*) of the guide, thereby preventing the seat from inadvertently lowering, and thus aids in maintaining the seat in the vertical position until such time the user closes the seat by moving the upper lift device rearward to the home position.

To aid in the lifting of the seat, the lower lift device may include a tensioned spring (30) which is secured to both the upper and lower members of the lower lift device, as illustrated in the FIGS. 4–5. When the seat is lifted, as shown in FIG. 5, for example, the spring is compressed at a particular tension. The tension may be adjusted if desired.

The inventive lifting apparatus may also include a means for flushing the toilet. The flushing means (26) is preferably a chain that is secured to the existing flush lever (16) of the toilet at one end and to the upper lift device (21) at the other end, most preferably to the stop (25), as shown in FIGS. 1–3, for example. To actuate the flushing means, the user pushes downward (i.e. toward the floor (F)) upon the handle (21*a*). This action simultaneously pushes the lower end of the chain downward to actuate the flush lever (16).

As discussed above, the inventive toilet seat lift may also be mounted to a commercial toilet as illustrated in FIGS. 6–7. Many toilets designed for commercial use do not have a tank (T) as shown in FIG. 1 but rather employ a pipe or conduit (P), as illustrated in FIGS. 6–7, for the purpose of moving fluid into the toilet bowl (14). Since the commercial toilet as shown does not have a tank, the guide (230) may be secured to the pipe (P) by a screw clamp (230*b*) (also known in the art as a Bandaid Clamp) or any other suitable attachment means, as discussed above. Alternatively, the guide (230) could be secured directly to the wall behind the toilet (not shown). Also, the lifting apparatus may include a flushing means (260) secured at one end to a flushing bar (160) and at the other end to the upper lift device (21), preferably to the stop (25). As described above for the residential toilet, when the user pushes down upon the handle (21*a*) of the upper lift device (21), the flushing means (260) simultaneously moves downward to pull upon, and thereby actuate, the flush bar (160). Especially for commercial toilets that employ flush bars, the flushing means should be particularly strong, since the flush bar, as compared to a flush lever (16) found on residential toilets, is often larger and requires more force to actuate.

The inventive lifting apparatus may be fabricated by any conventual, durable material typically employed in the plumbing industry, preferably a metal or metal alloy, a plastic, or some combination thereof.

Finally, it will be appreciated to one of ordinary skill in the art that the inventive lifting apparatus is not limited to lifting toilet seats, but may be adjusted to lift a toilet lid (14). In this embodiment (not shown), the bar would be positioned underneath the lid, as opposed to the seat, thereby being disposed between the lid and seat when the two are in the "closed" (i.e. horizontal) position. User operation of this embodiment to lift the lid (as well as flush the toilet, if this feature is also employed as described above) is identical to that described above for lifting a toilet seat.

The foregoing disclosure and description of the invention are illustrative and explanatory thereof, and various changes in the size, shape, and materials, as well as in the details of the illustrated construction may be made without departing from the spirit of the invention.

I claim:

1. A toilet assembly comprising, in combination:

a toilet bowl having an upper surface; a seat pivotly secured and positioned rearwardly on said upper surface of said bowl; and a seat lift apparatus mounted on said toilet bowl, said apparatus further comprising:

a lower lift device having a lower member secured to said toilet bowl, an upper member having one end pivotly connected to said lower member, and a bar secured at a second end of said upper member and positioned beneath said seat, wherein said seat rests upon said bar, said bar further extending from an outer edge toward an inner edge of said seat;

an upper lift device secured at one end to said upper member; and a guide having upper and lower surfaces and further configured to define an aperture through which said upper lift device is positioned and guided upon movement therethrough;

whereby when said upper lift device is pulled forward within said guide, said bar moves rearwardly as said upper member of said lower lift device pivots upwardly to lift said seat.

2. The toilet assembly of claim 1, wherein said upper lift device further includes a stop mounted on said upper lift device and positioned below said guide, wherein said stop has a width larger than the aperture of the guide; whereby when said upper lift device is moved forward within said guide, said stop moves vertically towards said guide until said stop contacts the lower surface of said guide, thereby limiting any further forward movement of said upper lift device.

3. The toilet assembly of claim 1, wherein said upper lift device includes a means for retaining said upper lift device in a forward position, wherein said retaining means is secured to said upper lift device below said guide when said toilet seat is positioned horizontally; whereby when said upper lift device is moved forward within said guide, said retaining means passes through the aperture of the guide and rests on the upper surface of the guide to maintain said upper lift device in said forward position absent further user actuation thereof.

4. The toilet assembly of claim 1, wherein said toilet further includes a means for moving fluid into said toilet bowl, said fluid moving means positioned rearward of said toilet bowl and further including said guide and a flush lever mounted thereon, and wherein said apparatus further includes a means attached to said flush lever for actuating said lever, said flushing means secured at one end to said lever and at another end to said upper lift device below said guide; whereby when said upper lift device is moved downward, said flushing means moves downward to actuate said flush lever to move fluid contained within said fluid moving means into said toilet bowl.

5. The toilet assembly of claim 4, wherein said fluid moving means includes a tank for receiving and storing fluid for subsequent movement into said toilet bowl.

6. The toilet assembly of claim 4, wherein said fluid moving means includes a conduit through which fluid flows into said toilet bowl.

7. The toilet assembly of claim 1, wherein said lower lift device includes a spring attached at one end to said upper member and at a second end to said lower member of said lower lift device, whereby said spring has a sufficient compression to aid in lifting said seat when said seat lift apparatus is actuated.

8. The toilet assembly of claim 1, said toilet further including a base subjacent to said toilet bowl, wherein said second end of said lower member of said lower lift device is secured to said base.

9. The toilet assembly of claim 8, wherein said lower member includes an L-shaped section having a hole for receiving a fastener for securing said lower member to said base.

10. The toilet assembly of claim 1, wherein said upper member of said lower lift device comprises a plurality of bar holes, wherein said bar is engaged within one of said bar holes.

* * * * *